US005542140A

United States Patent [19]

Ellinwood

[11] Patent Number: 5,542,140

[45] Date of Patent: Aug. 6, 1996

[54] SCRAPER ATTACHMENT FOR A HAMMER

[76] Inventor: Laroy R. Ellinwood, R.R.1 Box 46, Damariscotta, Me. 04543

[21] Appl. No.: 316,223

[22] Filed: Sep. 30, 1994

[51] Int. Cl.[6] ..... B25D 1/04

[52] U.S. Cl. ..... 7/146; 30/169; 7/105

[58] Field of Search ..... 7/105, 143, 144, 7/146; 30/169

[56] References Cited

U.S. PATENT DOCUMENTS

| | | | |
|---|---|---|---|
| 1,598,420 | 8/1926 | Brossett | 7/105 |
| 2,506,083 | 5/1950 | Hollander | 30/169 |

FOREIGN PATENT DOCUMENTS

| | | | |
|---|---|---|---|
| 634096 | 11/1927 | France | 7/146 |

*Primary Examiner*—James G. Smith

[57] ABSTRACT

Disclosed is a combination scraper and hammer for improving a conventional hammer by adding a removable scraper to facilitate scraping of paint, ice, concrete, and the like from a surface. The combination scraper and hammer comprises a scraper body having first and second parallel edges. A scraping blade is formed along the first edge and has a sharpened scraping edge thereon. An arcuate clamping band is formed along the second end. The band engages the hammer handle such that the scraping edge is positioned generally parallel to and spaced away from the top surface of the hammer head. The clamping band has an integrally formed ear projecting outwardly from both ends thereof. A U-bolt engages the hammer handle opposite the clamping band. The U-bolt extends through a hole through each clamping band ear and is secured with a pair of nuts whereby removably securing the scraper to the hammer. An alternate embodiment of the invention comprises a hammer head with a scraper formed integral therewith.

1 Claim, 4 Drawing Sheets

SCRAPER ATTACHMENT FOR A HAMMER

BACKGROUND OF THE INVENTION

1. Field of the Invention

The present invention relates to scrapers and more particularly pertains to a combination scraper and hammer which may be adapted for improving a conventional hammer having a hammer head attached to one end of an elongated handle by adding a removable scraper to facilitate scraping of paint, ice, concrete, and the like from a surface.

2. Description of the Prior Art

The use of scrapers is known in the prior art. More specifically, scrapers heretofore devised and utilized for the purpose of removing adherent matter from a surface are known to consist basically of familiar, expected and obvious structural configurations, notwithstanding the myriad of designs encompassed by the crowded prior art which have been developed for the fulfillment of countless objectives and requirements.

The present invention is directed to improving devices for removing adherent matter from a surface in a manner which is safe, secure, economical and aesthetically pleasing.

Relevant prior art patents include U.S. Pat. No. 4,581,782 to Riley which describes a hammer and U.S. Pat. No. 4,242,780 to Littman which discloses a hammer with chipping blade.

The prior art also discloses a paint can opener as shown in U.S. Pat. No. 5,127,121 to Bossie, a combination tool, in particular for motor vehicles of U.S. Pat. No. 5,251,351 to Klotz, and a scraper-hammer tool in U.S. Pat. No. 5,097,554 to McLaughlin.

While these devices fulfill their respective, particular objectives and requirements, the aforementioned patents do not disclose a combination scraper and hammer for improving a conventional hammer by adding a removable scraper to facilitate scraping of paint, ice, concrete, and the like from a surface.

In this respect, the combination scraper and hammer according to the present invention substantially departs from the conventional concepts and designs of the prior art, and in so doing provides an apparatus primarily developed for the purpose of improving a conventional hammer by adding a removable scraper to facilitate scraping of paint, ice, concrete, and the like from a surface.

Therefore, it can be appreciated that there exists a continuing need for a new combination scraper and hammer which can be used for improving a conventional hammer having a hammer head attached to one end of an elongated handle by adding a removable scraper to facilitate scraping of paint, ice, concrete, and the like from a surface. In this regard, the present invention substantially fulfills this need.

As illustrated by the background art, efforts are continuously being made in an attempt to develop devices for removing adherent matter from a surface. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of scrapers now present in the prior art, the present invention provides a new scraper construction wherein the same can be utilized for improving a conventional hammer by adding a removable scraper to facilitate scraping of paint, ice, concrete, and the like from a surface. As such, the general purpose of the present invention, which will be described subsequently in greater detail, is to provide a new combination scraper and hammer apparatus and method which has all the advantages of the prior art scrapers and none of the disadvantages.

The invention is defined by the appended claims with the specific embodiment shown in the attached drawings. For the purpose of summarizing the invention, the invention may be incorporated into a combination scraper and hammer for improving a conventional hammer having a hammer head attached to one end of an elongated handle by adding a removable scraper to facilitate scraping of paint, ice, concrete, and the like from a surface.

The combination scraper and hammer comprises a generally planar elongated trapezoidal steel scraper body having first and second parallel edges, the first edge being longer than the second edge. A scraping blade is integrally formed along the first edge of the scraper body and has a sharpened scraping edge formed thereon.

The blade is slightly outwardly angled relative the major plane of the body for increasing the angle at which the scraping edge contacts the surface. The increased angle reduces the likelihood of the blade digging into the surface.

An arcuate clamping band is integrally formed along the second end of the scraper body. The band is engaged with the hammer handle proximal the hammer head such that the major plane of the scraper body is angled outwardly relative the major plane of the hammer. The outwardly angled scraper body positions the scraping edge generally parallel to and spaced away from the top surface of the hammer head. The clamping band has an integrally formed ear projecting outwardly from both ends thereof, each ear having a hole therethrough.

A U-bolt engages the hammer handle opposite the clamping band. The U-bolt extends through the hole through each clamping band ear and is secured with a pair of nuts whereby removably securing the scraper body to the hammer.

An alternate embodiment of the invention comprises a hammer head with a scraper formed integral therewith.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a combination scraper and hammer for improving a conventional hammer by adding a removable scraper to facilitate scraping of paint, ice, concrete, and the like from a surface.

It is another object of the present invention to provide a new combination scraper and hammer which may be easily and efficiently manufactured and marketed.

It is a further object of the present invention to provide a new combination scraper and hammer which is of a durable and reliable construction.

An even further object of the present invention is to provide a new combination scraper and hammer which is susceptible of a low cost of manufacture with regard to both materials and labor, and which accordingly is then susceptible of low prices of sale to the consuming public, thereby making such combination scraper and hammer economically available to the buying public.

Still yet another object of the present invention is to provide a new combination scraper and hammer which provides in the apparatuses and methods of the prior art some of the advantages thereof, while simultaneously overcoming some of the disadvantages normally associated therewith.

Still yet another object of the present invention is to provide a combination scraper and hammer that does not interfere with the normal operation of the hammer, including nail pulling with a hammer claw and storage within a conventional hammer holster.

Yet another object of the present invention is to provide a combination scraper and hammer that saves time by eliminating the extra hand/arm movements and hunting required to pick up a separate scraper tool.

Even still another object of the present invention is to provide a combination scraper and hammer that may be quickly and easily attached to and removed from the hammer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
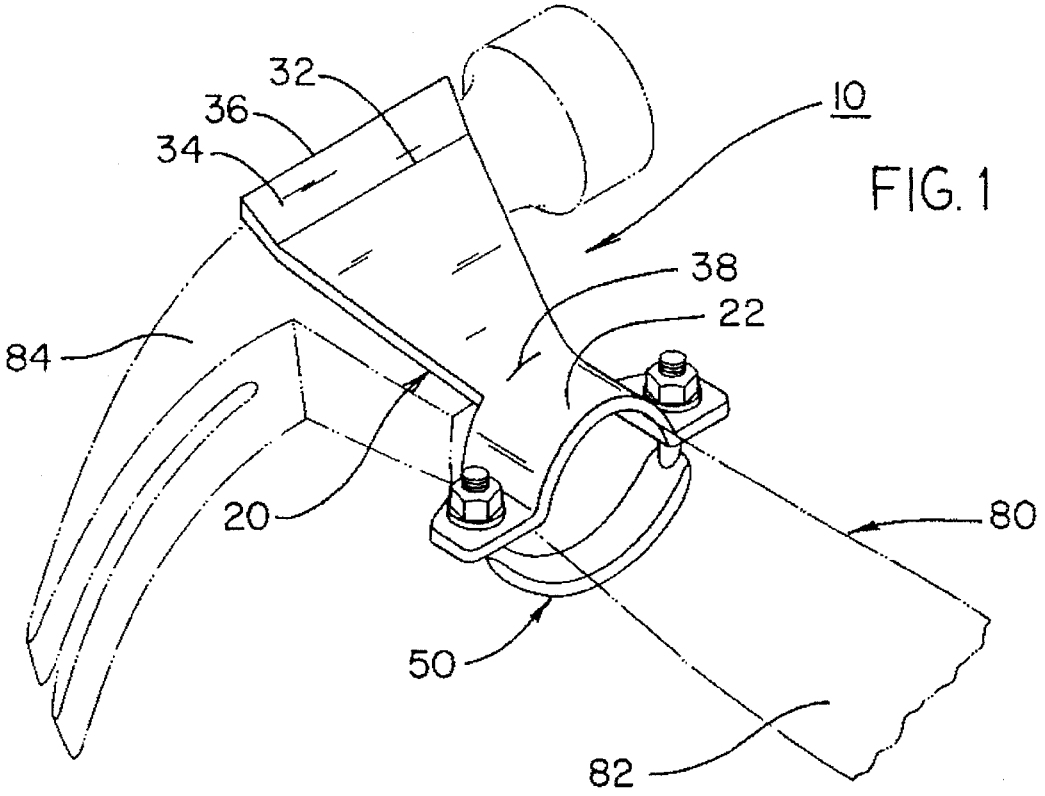
FIG. 1 is a perspective view of the preferred embodiment of the present invention combination scraper and hammer illustrating its manner of attachment to the hammer.

With reference now to the drawings, and in particular to FIG. 1 thereof, a combination scraper and hammer embodying the principles and concepts of the present invention and generally designated by the reference numeral 10 will be described.

Figure 2:
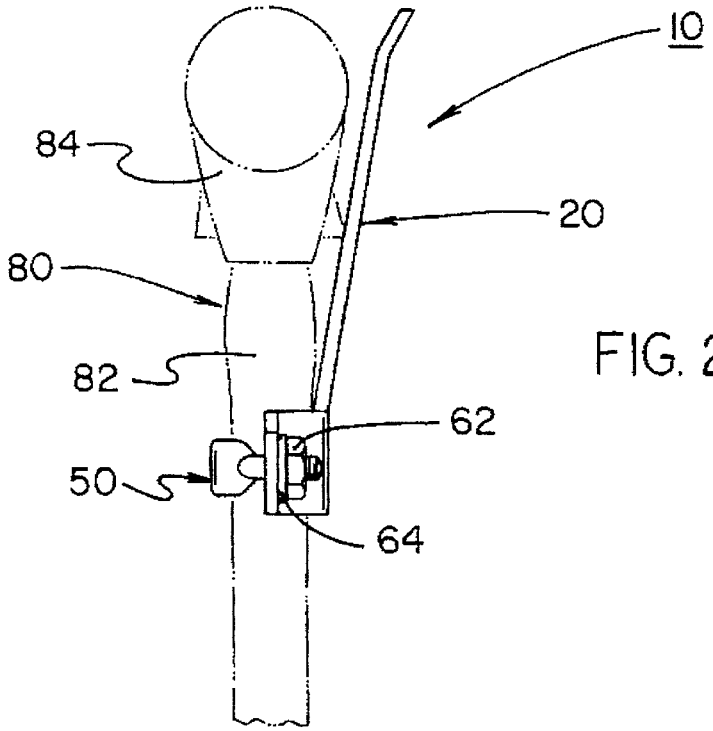
FIG. 2 is a front elevational view of the invention of FIG. 1.
Figure 3:
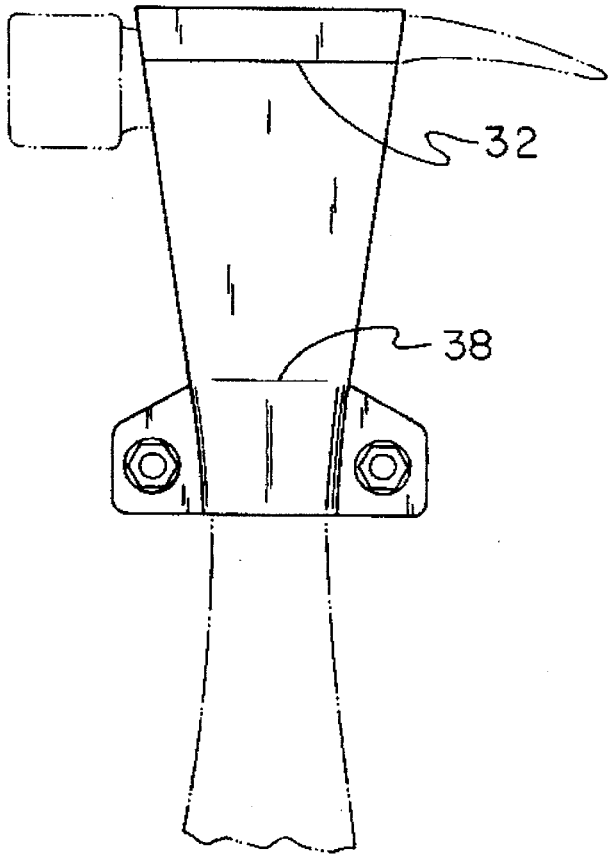
FIG. 3 is a side elevational view of the invention of FIG. 1.
Figure 4:
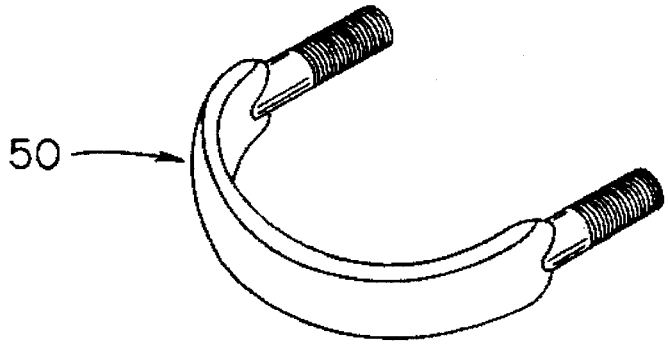
FIG. 4 is a perspective view of the U-bolt of the invention of FIG. 1.
Figure 5:
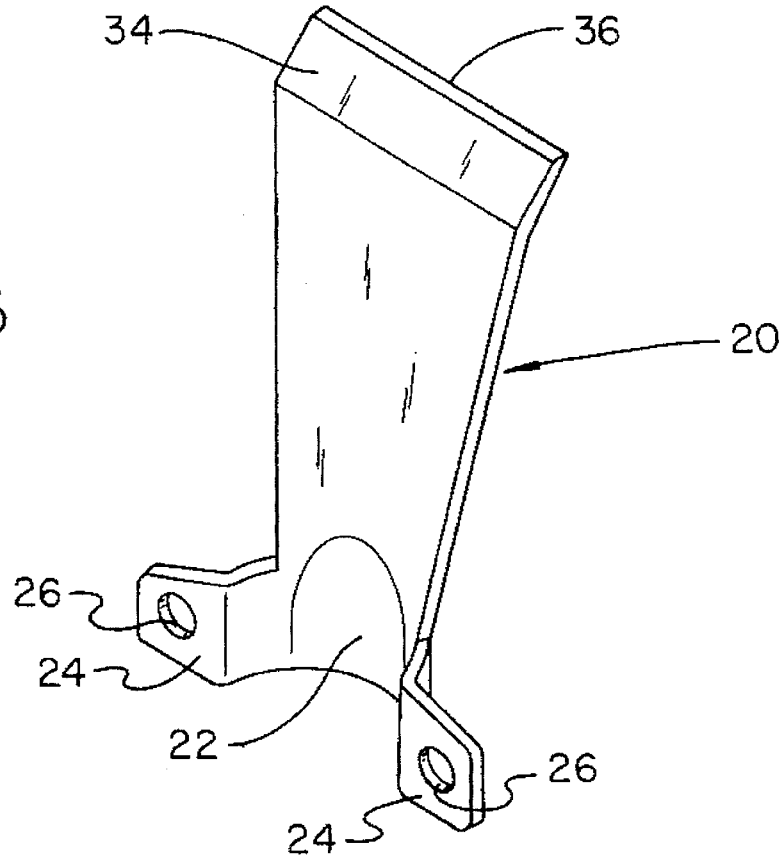
FIG. 5 is a perspective view of the scraper body of the invention of FIG. 1 showing the scraping blade across the top and the clamping band across the bottom thereof.
Figure 6:
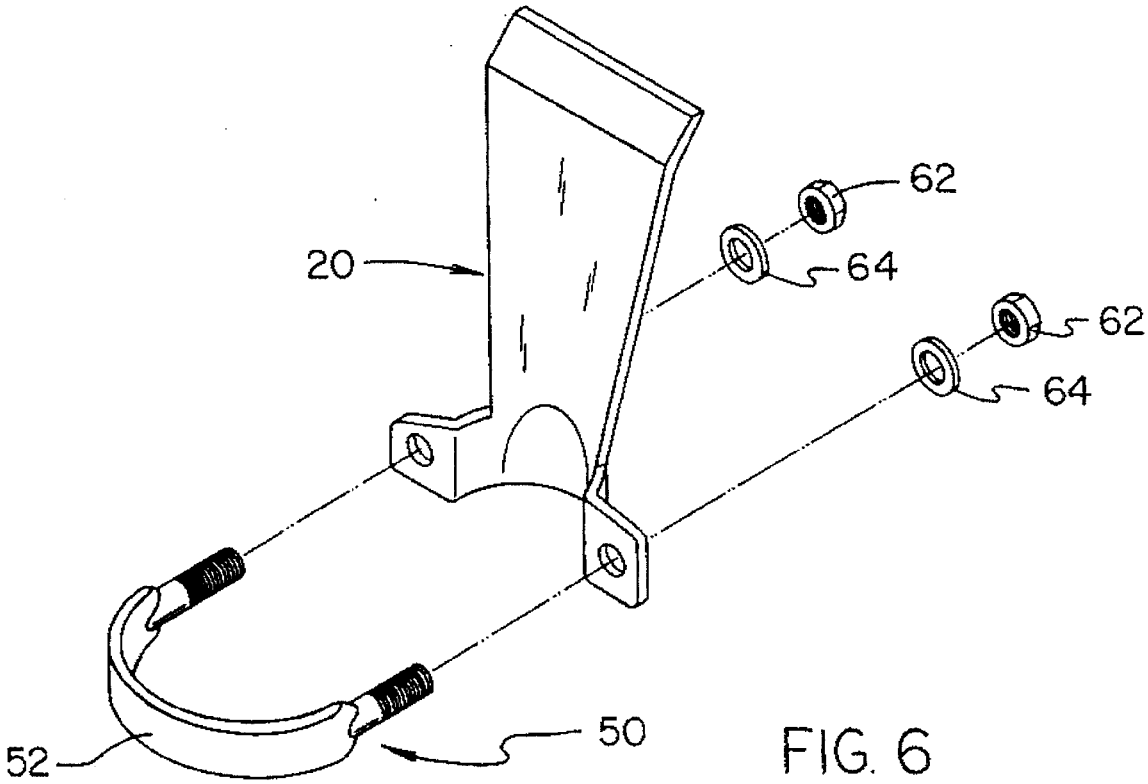
FIG. 6 is an exploded view of the invention of FIG. 1.
Figure 7:
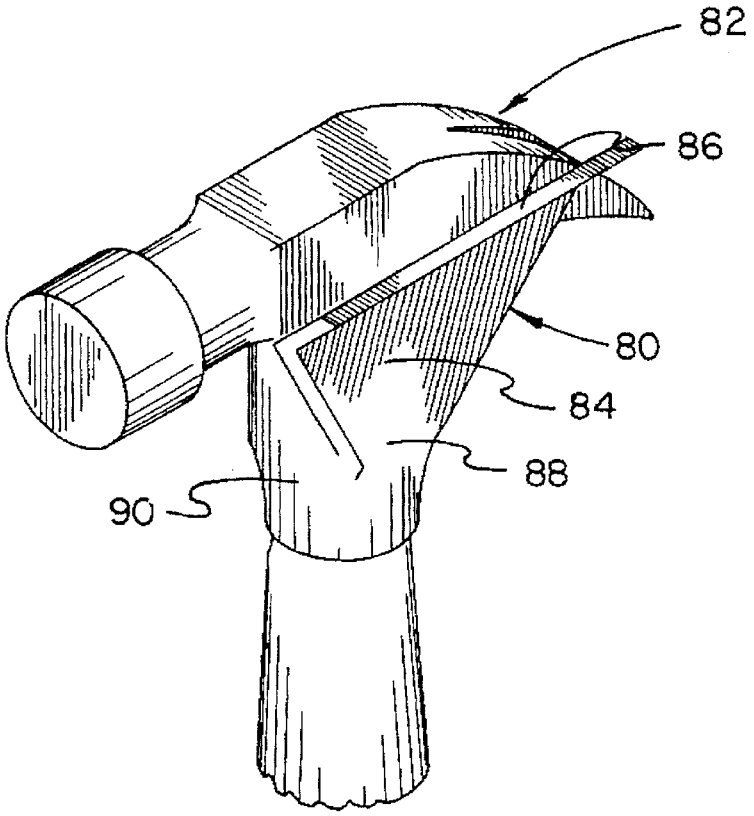
FIG. 7 is a perspective view of an alternate embodiment of the invention wherein a scraper is formed integrally with a hammer head.
Figure 8:
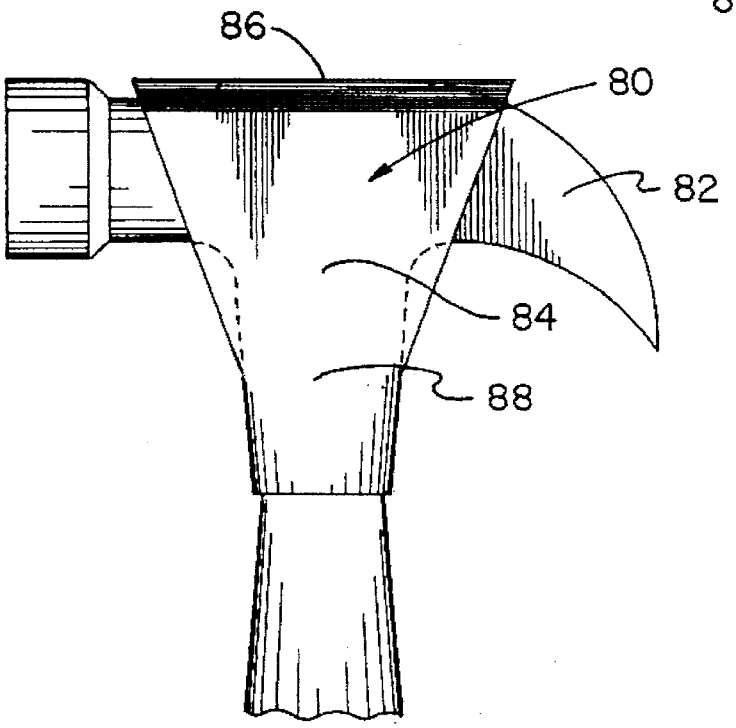
FIG. 8 is an elevational view of the alternate embodiment of FIG. 7.
Figure 9:
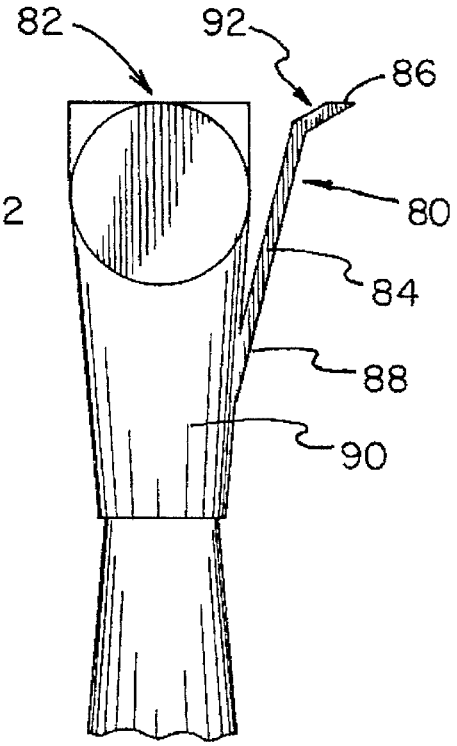
FIG. 9 is an end view of the alternate embodiment of FIG. 7.

From an overview standpoint, the combination scraper and hammer 10 is adapted for use for improving a conventional hammer 80 having a hammer head 84 attached to one end of an elongated handle 82 by adding a removable scraper 10 to facilitate scraping of paint, ice, concrete, and the like from a surface. See FIG. 2.

With reference now to FIGS. 1–6 and more specifically, it will be noted that a combination scraper and hammer 10 is shown. The combination scraper and hammer 10 comprises a generally planar elongated trapezoidal steel scraper body 20 having first and second parallel edges 32 and 38, the first edge 32 being longer than the second edge 38. A scraping blade 34 is integrally formed along the first edge 32 of the scraper body 20 and has a sharpened scraping edge 36 formed thereon.

The blade 34 is slightly outwardly angled relative the major plane of the body 20 for increasing the angle at which the scraping edge 36 contacts the surface. The increased angle reduces the likelihood of the blade digging into the surface.

An arcuate clamping band 22 is integrally formed along the second end 38 of the scraper body 20. The band 22 is engaged with the hammer handle 82 proximal the hammer head 84 such that the major plane of the scraper body 20 is angled outwardly relative the major plane of the hammer 80. The outwardly angled scraper body 20 positions the scraping edge 36 generally parallel to and spaced away from the top surface of the hammer head 84. The clamping band 22 has an integrally formed ear 24 projecting outwardly from both ends thereof, each ear 24 having a hole 26 therethrough.

A U-bolt 50 engages the hammer handle 80 opposite the clamping band 22. The U-bolt 50 has a flattened arcuate portion 52 to improve purchase on the hammer handle 82. The U-bolt 50 extends through the hole 26 through each clamping band ear 24 and is secured with a pair of nuts 62 whereby removably securing the scraper 10 to the hammer 80. Each nut 62 has a lock washer 64 disposed thereunder to prevent loosening of the nut 62 due to vibration caused by the shock of hammer impact.

An alternate embodiment of the invention comprises a scraper 80, as described above, formed integrally with a hammer head 82. The scraper comprises a generally planar elongated trapezoidal steel scraper body 84. The scraper body has first sharpened end 86 and a second end 88 integral with the handle receiving portion 90 of the hammer head. The blade is angled away from the body of the hammer head for increasing the angle at which the scraping edge contacts the surface and provides for a flexing motion being imparted into the scraper body for enhancing the efficiency at which material is removed by the scraper while angle reducing the likelihood of the blade digging into the surface. Further, the sharpened end 86 comprises a further angle portion 92 relative to the scraper body. The angle portion 92 is formed at an obtuse angle relative to the scraper body for providing maximum scraping efficiency.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A combination scraper and hammer comprising:

a hammer having a hammer head and a handle, the hammer head and handle having a contiguous longitudinal axis, the hammer head having an upper planar surface;

a scraper body having a first sharpened end and a second end, the second end of the scraper body being formed integrally with the hammer head, the scraper body being outwardly angled relative to the longitudinal axis of the hammer head and handle of the hammer, the scraper body having an elongated generally planar trapezoidal shape with the first sharpened end being longer than the second end, an angle portion including an intermediate bend being formed adjacent the first sharpened end at an obtuse angle relative to the scraper body for providing maximum scraping efficiency, the angle portion having an upper planar surface positioned essentially parallel to and in alignment with the upper planar surface of the hammer head.

* * * * *